US009687752B2

(12) United States Patent
Clark et al.

(10) Patent No.: US 9,687,752 B2
(45) Date of Patent: Jun. 27, 2017

(54) KIT FOR SCULPTURING THREE-DIMENSIONAL OBJECTS AND A METHOD OF USING THE SAME

(71) Applicants: Gayle W. Clark, Wortham, TX (US); Brian J. Mahan, Wortham, TX (US)

(72) Inventors: Gayle W. Clark, Wortham, TX (US); Brian J. Mahan, Wortham, TX (US)

( * ) Notice: Subject to any disclaimer, the term of this patent is extended or adjusted under 35 U.S.C. 154(b) by 355 days.

(21) Appl. No.: 13/827,260

(22) Filed: Mar. 14, 2013

(65) Prior Publication Data

US 2014/0261957 A1 Sep. 18, 2014

(51) Int. Cl.

| | |
|---|---|
| ***B44C 3/06*** | (2006.01) |
| ***A63F 9/12*** | (2006.01) |
| ***A63H 33/32*** | (2006.01) |
| ***B44C 3/04*** | (2006.01) |

(52) U.S. Cl.

CPC ..... *A63H 33/32* (2013.01); *B44C 3/046* (2013.01); *B44C 3/06* (2013.01); *A63F 9/1288* (2013.01); *A63F 2009/1292* (2013.01)

(58) Field of Classification Search

CPC .. G09B 19/10; B44C 3/06; B44C 3/04; B44C 3/046; B44C 3/048; B44C 3/02; A63H 33/001; B44B 1/00; B44B 1/06; B44B 11/00; A63F 9/1288; A63F 2009/1292

USPC ..... 434/82, 81

See application file for complete search history.

(56) References Cited

U.S. PATENT DOCUMENTS

| | | | | |
|---|---|---|---|---|
| 2,358,530 | A | | 9/1944 | Nassour |
| 2,545,210 | A | | 3/1951 | Moore |
| 2,725,654 | A | | 12/1955 | Kosikar |
| 2,743,535 | A | * | 5/1956 | Hanks ..... 434/82 |
| 2,755,587 | A | | 7/1956 | Hirst |
| 2,803,903 | A | | 8/1957 | Barry |
| 2,831,286 | A | | 4/1958 | Eisner |
| 3,044,185 | A | | 7/1962 | Daniel |
| 3,054,711 | A | | 9/1962 | Powell |
| 3,055,119 | A | | 9/1962 | McEwen |
| 3,064,365 | A | * | 11/1962 | Ganine ..... 434/82 |
| 3,301,725 | A | * | 1/1967 | Frontera ..... 156/59 |
| 3,341,396 | A | * | 9/1967 | Iverson ..... 428/142 |
| 3,883,456 | A | | 5/1975 | Finck |
| 4,003,142 | A | | 1/1977 | Morrison et al. |
| 4,514,175 | A | | 4/1985 | Zaruba et al. |
| 4,578,131 | A | | 3/1986 | Hawkins |
| 4,674,981 | A | | 6/1987 | LaPadura |
| 4,781,597 | A | | 11/1988 | Cowley |
| 4,908,001 | A | | 3/1990 | Kopian |
| 5,171,151 | A | | 12/1992 | Barthold |

(Continued)

FOREIGN PATENT DOCUMENTS

| | | | |
|---|---|---|---|
| DE | 2239682 A1 | * | 2/1973 |
| FR | 2646811 A | * | 11/1990 |

(Continued)

*Primary Examiner* — William Bell

(74) *Attorney, Agent, or Firm* — Marc L. Delflache; Jones Delflache LLP

(57) ABSTRACT

A sculpting kit is provided that allows individuals with a means to sculpt a three-dimensional object. Components which form the armature of the three-dimensional object may be adfixed to a planar surface as two-dimensional elements. The sculptured object may be prepared by using the kit to lay down successive layers of structures in a pre-arranged fashion.

29 Claims, 8 Drawing Sheets

(56) References Cited

U.S. PATENT DOCUMENTS

| | | | | | |
|---|---|---|---|---|---|
| 5,171,614 | A | | 12/1992 | Keith | |
| 5,435,518 | A | | 7/1995 | Iguchi | |
| 5,516,314 | A | | 5/1996 | Anderson | |
| 5,686,154 | A | * | 11/1997 | Brown, Jr. | 428/15 |
| 5,690,231 | A | | 11/1997 | Erickson | |
| 5,727,979 | A | | 3/1998 | Spector | |
| 5,741,140 | A | | 4/1998 | Bristol | |
| 5,760,369 | A | * | 6/1998 | Wenkman | 219/121.71 |
| 5,954,561 | A | | 9/1999 | Cannone | |
| 6,010,387 | A | | 1/2000 | Nemec et al. | |
| 7,186,161 | B2 | | 3/2007 | Salas Peralta | |
| 7,473,156 | B2 | | 1/2009 | Hsieh | |
| 7,862,399 | B1 | | 1/2011 | Culpepper | |
| 8,024,876 | B2 | | 9/2011 | Bettin, Jr. | |
| 2004/0265511 | A1 | * | 12/2004 | Miller et al. | 428/16 |
| 2006/0154214 | A1 | | 7/2006 | Miller et al. | |
| 2012/0175184 | A1 | | 7/2012 | Harrison et al. | |

FOREIGN PATENT DOCUMENTS

| | | | | |
|---|---|---|---|---|
| GB | 1401619 | A | * | 7/1975 |
| GB | 2222395 | A | * | 3/1990 |

* cited by examiner

KIT FOR SCULPTURING THREE-DIMENSIONAL OBJECTS AND A METHOD OF USING THE SAME

FIELD OF THE DISCLOSURE

The disclosure relates to a kit for sculpturing three-dimensional objects and to a method of sculpturing three-dimensional objects using the kit.

BACKGROUND OF THE DISCLOSURE

There is a wide variety of craft or activity sets available for children and to those who are not artistically talented for creating artistic displays. For example, paint by number kits have provided children with many hours of enjoyment. Other kits enable individuals to use colored, patterned or textured fabrics in order to create elements of an overall design. In some of these kits, stuffing may be provided to animate created objects. In addition, certain kits allow for the making of soft sculptures by the use of compressible substances. Other may include pre-cut fabric pieces, stuffing, a backing sheet with a preprinted design, thread and a needle in a similar manner as a paint-by-number kit. Such kits do not, however, enable those who are not artistically talented to sculpt three-dimensional objects. Children, students, and adults often seek to sculpt a three-dimensional object but do not have the knowledge, ability or experience to do so.

In schools, the current approach to sculpting is very rudimentary. There is not a good methodology that allows inexperienced sculptors to successfully learn to develop their skills in the art. Younger children especially need assistance in transferring spatial relationships into forms of art.

It should be understood that the above-described discussion is provided for illustrative purposes only and is not intended to limit the scope or subject matter of the appended claims or those of any related patent application or patent. Thus, none of the appended claims or claims of any related application or patent should be limited by the above discussion or construed to address, include or exclude each or any of the above-cited features or disadvantages merely because of the mention thereof herein.

Accordingly, there exists a need for improved methods and materials useful in sculpturing three-dimensional objects having one or more of the attributes or capabilities described or shown in, or as may be apparent from, the other portions of this patent.

SUMMARY OF THE DISCLOSURE

The present disclosure involves a kit for sculpturing a three-dimensional object which contains:

(a) at least one planar surface member;

(b) a two-dimensional underframe on the at least one planar surface member bearing at least one identification marker and a shape-forming flexible material;

(c) at least one primary support structure on the at least one planar surface member for placement onto the underframe and bearing at least one identification marker on its surface;

(d) one or more secondary support structures on the at least one planar surface member bearing at least one identification marker;

(e) an adhesive for adhering the at least one primary support structure to the underframe and the one or more secondary support structures to the at least one primary support structure;

(f) a molding material for placement onto the surface of the underframe, primary support structure and the one or more secondary support structures; and (g) one or more colorants.

In another embodiment, the disclosure relates to a kit for sculpturing a three-dimensional object which contains:

(a) one or more two-dimensional elements on a planar surface member for forming the underframe of the sculpted three-dimensional object;

(b) at least one two-dimensional primary structure for placement onto the underframe, the at least one two-dimensional primary structure being on a planar surface member; and (c) at least one two-dimensional secondary structure for placement onto the at least one two-dimensional primary structure, the at least one two-dimensional secondary structure being on a planar surface member wherein at least one of component (a), (b) or (c) contains a shape-forming flexible material.

In another embodiment, the disclosure relates to a method of making a three-dimensional figurine by using a kit containing (a) at least one planar surface member;

(b) a two-dimensional underframe on the at least one planar surface member bearing at least one identification marker and a shape-forming flexible material;

(c) at least one primary support structure on the at least one planar surface member for placement onto the underframe and bearing at least one identification marker on its surface;

(d) one or more secondary support structures on the at least one planar surface member bearing at least one identification marker;

(e) an adhesive for adhering the at least one primary support structure to the underframe and the one or more secondary support structures to the at least one primary support structure;

(f) a molding material for placement onto the surface of the underframe, primary support structure and the one or more secondary support structures; and (g) one or more colorants.

by:

(i) adhering onto the underframe the at least one primary support structure and forming a sub-surface structure;

(ii) adhering the one or more secondary support structures onto the at least one primary support structure and forming an expanded three-dimensional structure;

(iii) forming an armature of a three-dimensional object;

(iv) applying the molding material onto the armature and hardening the molding material; and (v) applying the one or more colorants onto the hardened molding material.

wherein either the underframe, the at least one primary support structure or the one or more secondary support structures contains a shape-forming flexible material and further wherein each of the underframe, the at least one primary support structure or the one or more secondary support structure containing the shape-forming flexible material may be shaped by manipulating the shape-forming flexible material prior to step (c).

In another embodiment, the disclosure relates to a method of making a three-dimensional object using a kit containing (a) one or more two-dimensional elements on a planar surface member for forming the underframe of the sculpted three-dimensional object;

(b) at least one two-dimensional primary structure for placement onto the underframe, the at least one two-dimensional primary structure being on a planar surface member; and (c) at least one two-dimensional secondary structure for placement onto the at least one two-dimensional primary structure, the at least one two-dimensional secondary structure being on a planar surface member wherein at least one of component (a), (b) or (c) contains a shape-forming flexible material by:

(i) applying and adhering onto the underframe the at least one primary support structure and forming a sub-surface structure;

(ii) applying and adhering the one or more secondary support structures onto the at least one primary support structure and forming an expanded three-dimensional object;

(iii) forming an armature for the three-dimensional object comprising the underframe, at least one primary support structure and the one or more secondary support structures wherein the underframe, the at least one primary support structure and/or the one or more secondary support structures is shaped by manipulating the shape-forming flexible material prior to step (c).

Accordingly, the present disclosure includes features and advantages which are believed to enable it to advance sculpturing a three-dimensional figurine. Characteristics and advantages of the present disclosure described above and additional features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF THE PREFERRED EMBODIMENTS

Figure 1:
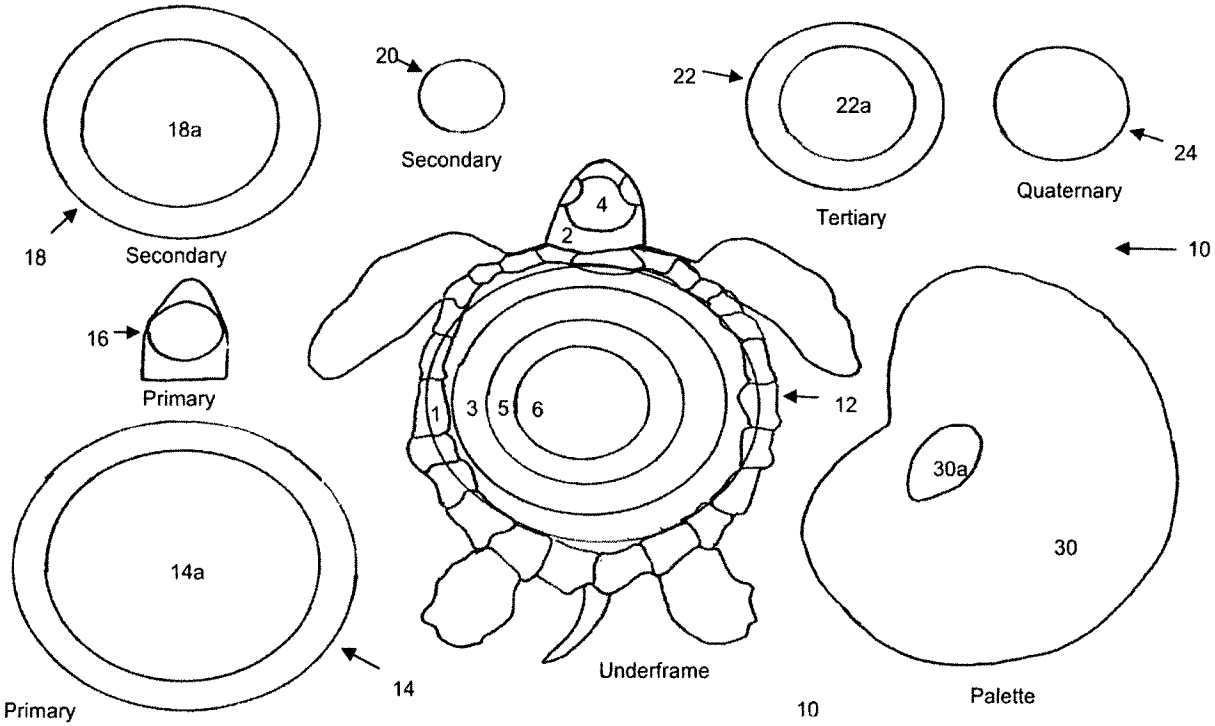
FIG. 1 depicts a first planar surface member of a kit for a sea turtle as disclosed herein containing the underframe and some support structures.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of example embodiments, are not intended to limit the claims of this patent or any patent or patent application claiming priority hereto. On the contrary, the intention is to cover all modifications, equivalents and alternatives falling within the spirit and scope of the claims. Many changes may be made to the particular embodiments and details disclosed herein without departing from such spirit and scope.

In showing and describing preferred embodiments in the appended figures, common or similar elements are referenced with like or identical reference numerals or are apparent from the figures and/or the description herein. The figures are not necessarily to scale and certain features and certain views of the figures may be shown exaggerated in scale or in schematic in the interest of clarity and conciseness.

The subject matter of the disclosure should not be considered as requiring every embodiment hereof or of any particular claim(s) merely because of such reference. Certain terms are used herein and in the appended claims to refer to particular components. As one skilled in the art will appreciate, different persons may refer to a component by different names. This document does not intend to distinguish between components that differ in name but not function. Also, the terms "including" and "comprising" are used herein and in the appended claims in an open-ended fashion, and thus should be interpreted to mean "including, but not limited to . . . ." Further, reference herein and in the appended claims to components and aspects in a singular tense does not necessarily limit the present disclosure or appended claims to only one such component or aspect, but should be interpreted generally to mean one or more, as may be suitable and desirable in each particular instance.

Preferred embodiments of the present disclosure thus offer advantages over the prior art and are well adapted to carry out one or more of the objects of this disclosure. However, the present invention does not require each of the components and acts described above and are in no way limited to the above-described embodiments or methods of operation. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims.

The disclosure relates to a unique sculpting kit which provides aspiring artists including students, children, novices and other adults with a tool to sculpt three dimensional objects. The kit may be used as a sculpting learning and teaching tool.

The disclosure also relates to a method of sculpting a three-dimensional object by use of the kit. Amongst other benefits, the kit and use of the kit provides the aspiring artist with an understanding of spatial arrangements which arise during the forming, structuring and layering of three-dimensional objects. Since the kit may include elements which can be shaped into three-dimensions, the artist is able to express his own thoughts and creativity into the sculptured object by manipulating such elements.

In an embodiment, the kit may include one or more two-dimensional planar surface members. The planar surface member may contain a two-dimensional underframe and at least one primary two-dimensional support structure. When assembled, such components form the armature of the sculpted product.

Optionally, one or more of the planar surface members could also contain an additional support element. When the armature is to consist of more than the underframe and the primary support structure(s), then the underframe and primary support structure(s) form a sub-surface structure. The sub-surface structure may be expanded to an expanded three-dimensional structure by the addition of the additional support element(s). For instance, where the kit includes an underframe, one or more primary support structure(s) and a secondary support structure, then the sub-surface structure may consist of the underframe and the primary support structure(s) and the expanded three-dimensional structure may then consist of the addition of the secondary support structure(s) onto the sub-surface structure. Where the kit includes an underframe, one or more primary support structure(s), a secondary support structure(s), and one or more tertiary structure(s), then the sub-surface structure may consist of the underframe and primary support structure(s) and the expanded three-dimensional structure may then consist of the addition of the secondary support structure(s) and tertiary support structure(s) onto the sub-surface structure, and so on.

One or more of the planar surface members may be a sculpt board containing elements for sustaining underframe, one or more primary support structure, one or more secondary support structures and/or additional support element(s).

The planar surface member may be composed of any material suitable for retaining the underframe, primary support structure(s) and, when used, the secondary support structure(s) and, the optional additional support element(s). For example, the planar surface member may be composed of soft plastic, paper, foam, etc.

The underframe, primary support structure(s) and optional secondary support structure(s) and additional support members may be secured onto the planar surface member(s) for easy removal by the user. For instance, such components may be removed from the sculpt board by existing as cut-outs. Further, such components may be pre-scored or perforated for easy removal from the sculpt board.

The underframe may be a single component or may consist of multiple components. Such components define the underframe for the sculpted object.

Onto the underframe may be applied one or more support structures. Such components are referred to as support structures since they may be present to offer the sculptured object a structural feature and/or support. It is the combination of the underframe and the support structures which forms the armature of the three-dimensional object.

The first support structure adhered directly to the underframe is referred to as "the primary support structure". The kit may contain one or more primary support structures for adhering on the underframe.

The additional support elements may consist of one or more secondary support structures. Such secondary support structures may be adhered directly onto one or more areas of the primary support structure. The additional support elements may also include one or more tertiary support structures. Such tertiary support structures may be adhered directly onto one or more areas of the secondary support structure(s). The additional support elements may also include one or more quaternary support structures. Such quaternary support structure(s) may be adfixed to one or more areas on the tertiary support structure(s). Further, additional support elements may include one or more quinary support structures. Such quinary support structure(s) may be adfixed to one or more areas on the quaternary support structure(s). Additional support elements may also include one or more senary support structures. Such senary support structure(s) may be adfixed to one or more areas on the quinary support structure(s), and so on. For purposes herein, the term "successive support structure" shall refer to the support structure applied onto a given structure and the term "preceding support structure" shall refer to the support structure applied prior to a given structure. Thus, for a quaternary support structure, the successive support structure shall be the quinary support structure and the preceding support structure shall be the tertiary support structure; for a quinary support structure, the successive support structure shall be the senary support structure and the preceding support structure shall be the quaternary support structure; and so on.

One or more of the components forming the underframe, the primary support structure(s), and, when present, the additional support structure(s) may contain a flexible material in order for the sculpted object to be manipulated into the shape desired by the individual. Typically, the flexible material is incorporated into the interior of one or more areas of the components. However, the flexible material may be on the exterior of one of the components as well.

For instance, a flexible material may be contained within the underframe in order that the underframe may be formed into a desired shape.

Suitable materials for the flexible material include wires, metallic sheets, and/or non-metallic, flexible materials, including synthetic materials, such as plastics, foam, etc.

The underframe as well as one or more of the support structures may bear one or more identification markers. The identification marker(s) may be numbers or letters or combination of numbers and letters or some other form of demarcation.

Identification marker(s) on the underframe may designate the area on the underframe for placement of the primary support structure(s). For example, each of the underframe and a primary support structure may be marked with "1". The sculptor will then know that the primary support structure marked with "1' is to be placed onto the underframe area which is also marked with "1". Further, the underframe may consist of two markers for placement of two different primary support structures. For instance, the underframe may be marked with "1" and "2". The sculptor will then recognize that the primary support structure marked with "1" is to be placed onto the underframe area which is also marked with "1" and the primary support structure marked with "2" is to be placed onto the area of the underframe which is marked with "2".

Additional support element(s) may bear an identification marker(s) for placement of the support element(s) in relation to its adjacent layer. For instance, a secondary support structure be marked with "3" for placement onto the primary support structure marked with "3", and so on. In this fashion, the user knows where to place the secondary support structure(s) on the primary support structure(s) and so on.

Thus, identification markers on the underframe, primary support structure(s) and optionally additional support element allows for the construction of the armature in a systematic manner and enables the user to view construction of the armature in three-dimensions and assists the ability of the user to grasp spatial visualization during construction of the three-dimensional object.

The kit may also include a molding material, an adhesive, one or more colorants, user hand tools, as well as other components desired by a user.

Suitable molding material is any substance for application onto the underframe, primary support structure(s) and additional support structure(s) for forming the armature. After the molding material is hardened or cured, the formed product may be stylized and colored based on the desires of the individual. The finished sculpture thus contains a colored armature.

The adhesive is used to adhere the underframe, primary support structure(s) and optional additional support structure(s) together. Any suitable adhesive may be used, such as a resin based epoxy resin, tackifying resin, etc. Further, the adhesive may be within the kit in the form of tabs, sticks or squeeze containers.

Suitable colorant(s) for inclusion into the kit include colorants lacquers, acrylics, paints, etc.

Suitable hand tools which may be included in the kit are any of those desired by the user to construct the sculpted object. Exemplary hand tools include molding applicators, such as a dowel, for applying the molding material onto the armature, one or more paint brushes, dowel, etc.

Figure 2:
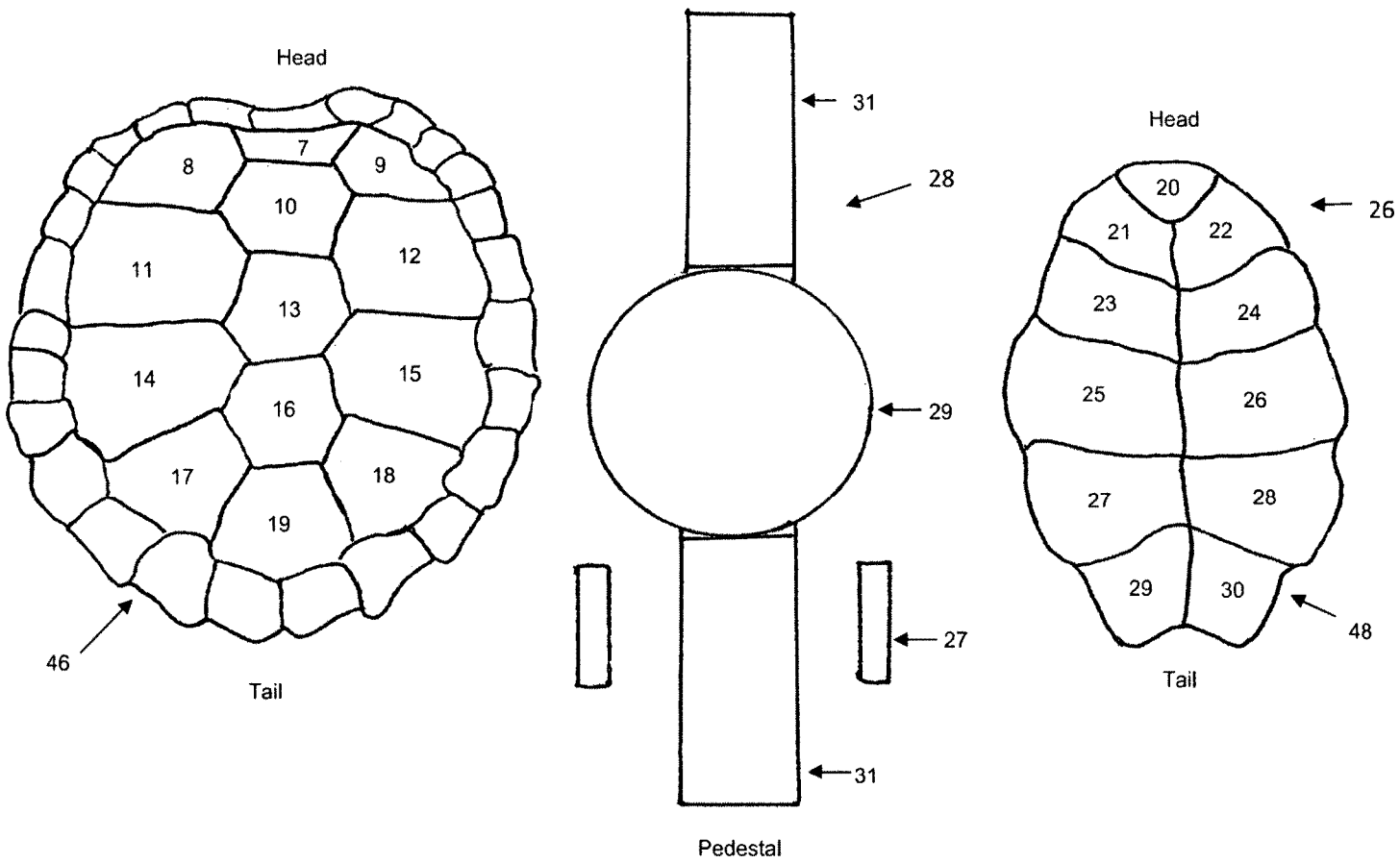
FIG. 2 depicts a second planar surface member of a kit for a sea turtle containing the upper carapace and lower plastron of a sea turtle.
Figure 3:
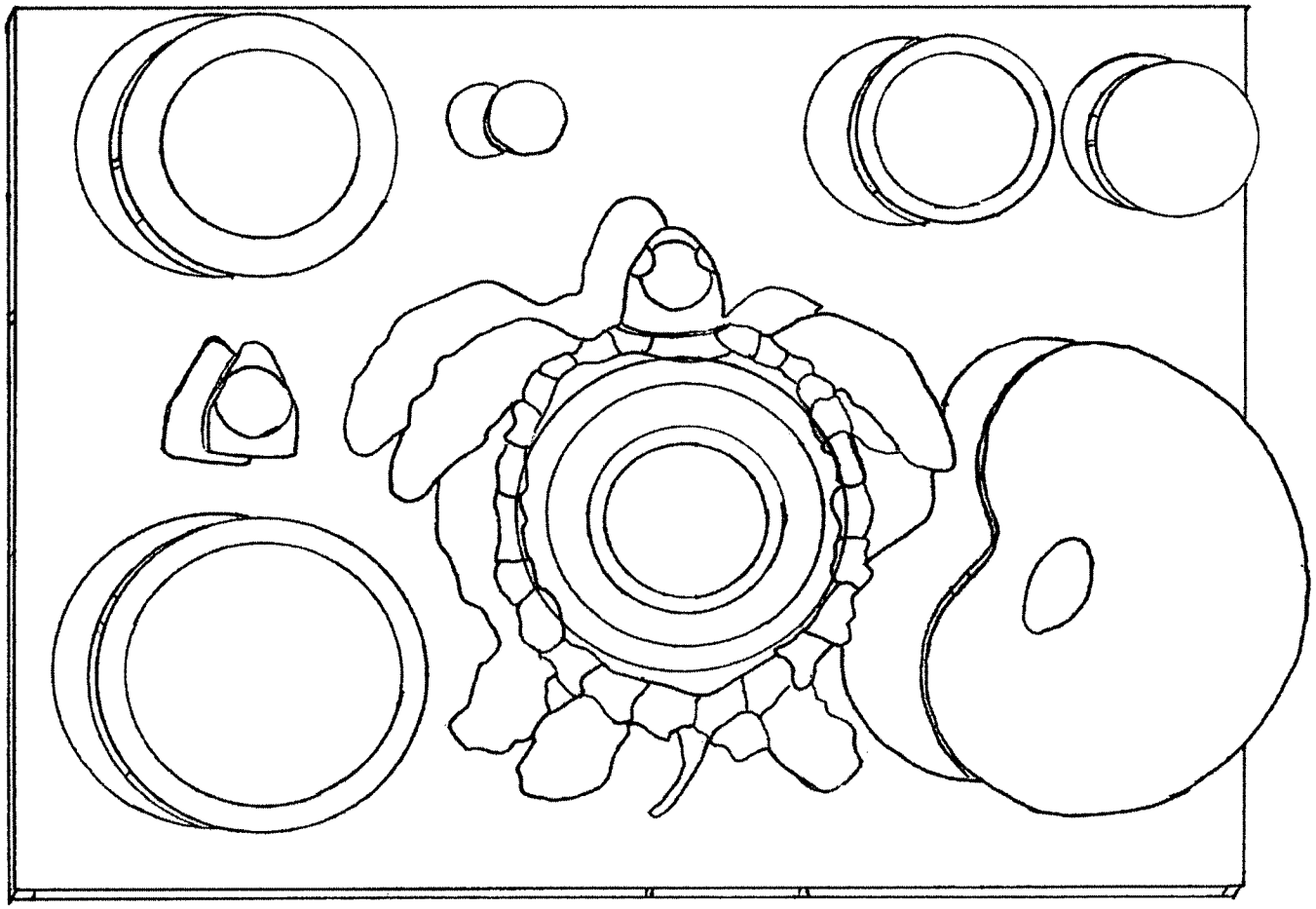
FIG. 3 depicts the planar surface member of FIG. 1 showing pre-cut components for sculpting of a sea turtle.

FIGS. 1-5 illustrate elements of a kit for making a sea turtle in accordance with the disclosure provided herein. As shown in FIG. 1, a two-dimensional first planar board 10 contains underframe 12 displaying the general outline of the sea turtle, including its carapace, legs and head. Four levels of support structures—primary, secondary, tertiary and quaternary—appear on first planar surface board 10 as represented by first primary support structure 14, second primary support structure 16, first secondary support structure 18, second secondary support structure 20, tertiary support structure 22 and quaternary support structure 24. Each of underframe and the support structures may be scored or pre-cut for easy removal from first board 10, as illustrated in FIG. 3.

One or more of the underframe 12 or support structures may contain a flexible material, such as a wire (not shown), in order to manipulate and configure the component to the shape desired by the user.

Second planar member 26 is illustrated in FIG. 2 and contains pedestal 28 composed of pedestal body 29 and feet 31 which may be removed and placed into pre-formed slots 27 on second planar member 26. Pedestal body 29 and feet 31 are removed from the second planar board 26. Each end of feet 31 closest to pedestal body 29 is bent at the edge of pedestal body 29 to form a "U" shape. The two male ends of feet 31 are then inserted into the two pre-punched female slots 33 of FIG. 4(*a*). Pedestal 28 may provide a station for placement of the three-dimensional object while it is being sculpted, cured and painted, if desired, FIG. 4(*b*).

Second planar member 26 also contains upper carapace 46 and lower plastron 48 of the sea turtle. Each of these components along with pedestal 28 may be pre-cut or scored in order for them to be easily popped out. In addition, any of the components of upper carapace 46 and/or lower plastron 48 may contain a shape-forming flexible material.

First primary support structure 14, second primary support structure 16, first secondary support structure 18, second secondary support structure 20, tertiary support structure 22 and quaternary support structure 24 are marked with identification marks "1", "2", "3", "4", "5", and "6", respectively. Underframe 12 may be marked with the same identification marks to illustrate to the user how each of the structures is laid in order to create the armature of the sea turtle.

Each of the components may be removed from first planar member 10 and second planar member 26. Pedestal 28 may be secured to second planar surface 26 by bending the two feet 31 of the pedestal and inserting into the two pre-punched slots 33 in second planar surface 26. Adhesive may then be applied to the back of first primary support structure 14 and the area having identification marker "1" is then fitted over identification marker "1" on underframe 12. As illustrated, underframe 12 may be marked with the identification marker "1" and first primary support structure 14 may be marked with identification marker "1" to enable the artist to recognize where the primary support structure is to be placed onto underframe 12. Similarly, second primary support structure 16 with identification marker "2" may be placed onto underframe 12 within the area identified as "2". If the user desires the mouth of the sea turtle to remain open, second primary support structure 16 may be hinged at the back by applying the adhesive to only the back edge of underframe 12.

Similarly, first secondary primary support structure 18 marked with identification marker "3" is then adhered over the first primary support structure 14 in the area defined by circle 14*a*. Similarly, second secondary support structure 18 marked with identification marker "4" may then be placed over the second primary support structure 16 within the area defined by identification marker "4". Second secondary support structure 20 and underframe 12 may be marked with similar identification markers—"4"—to enable the artist to recognize where the secondary support structure 20 is to be placed. Tertiary support structure 22 bearing identification marker "5" is adhered to first secondary support structure 18 in the area identified as 18*a*. Quaternary support structure 24 bearing identification marker "6" adhered into the tertiary support structure in the inner area defined as 22*a*.

In the resulting three-dimensional structure, first secondary support structure 18, shown as being numbered as "3", has been adhered onto first primary support structure 14 in the area marked as "3"; second secondary support structure 20 (marked as "4") has been adhered to secondary primary support structure 16 in the area marked as "4"; tertiary support structure 22 (marked with "5") has been adhered to first secondary support structure 18 in the area marked as "5"; and quaternary support structure 24 (marked as "6") has been adhered to tertiary support structure 22 in the area marked as "6".

Figure 4:
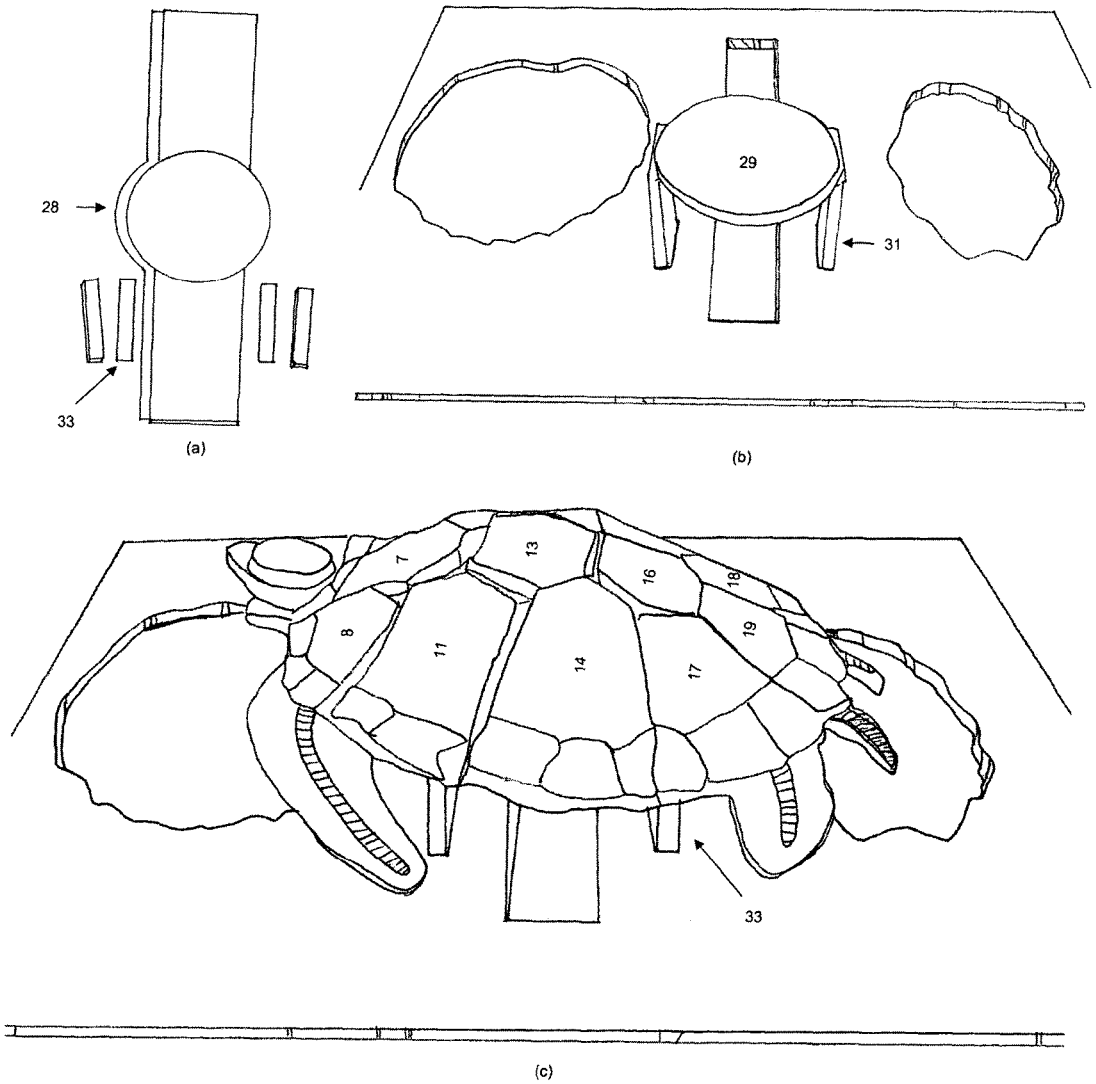
FIGS. 4(*a*), (*b*) and (*c*) depict the removable pedestal and a formed structure supported on the pedestal.
Figure 5:
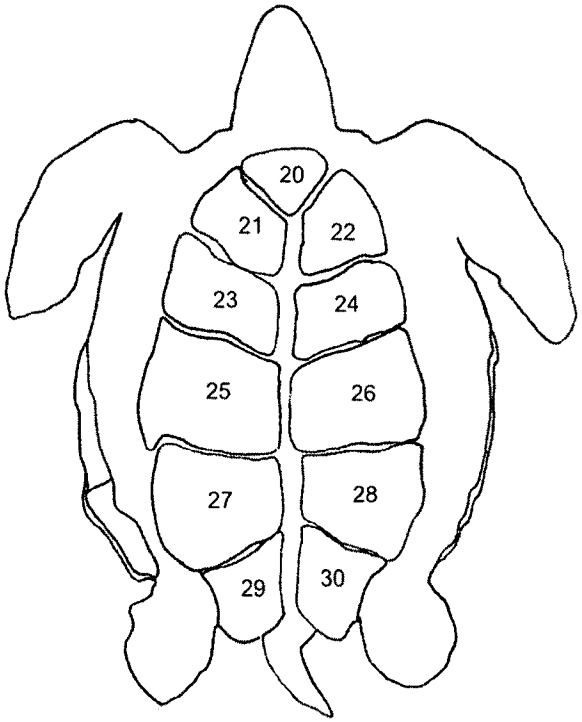
FIG. 5 depicts the attachment of a lower plastron onto the bottom of a sea turtle.

Second planar member 26 contains upper carapace 46 and lower plastron 48 of the sea turtle. Lower plastron 48 may be adhered by placing adhesive on the back of the segmented lower plastron parts and arranging them in numeric order, as illustrated (shown in as starting with identification marker "20" and working around the bottom of the sea turtle, arranging the parts as evenly as possible.) As an alternative, segmented lower plastron parts 20-30 may be pre-assembled onto lower plastron 48. FIG. 5 depicts the attachment of lower plastron 48 onto the top of the sea turtle. The upper carapace shell 46 of the sea turtle may be created by placing adhesive on the back of segmented upper carapace parts 7-19 and arranging them in numeric order, as illustrated. The attachment of upper carapace 46 onto the top of the sea turtle is shown in FIG. 4(*c*).

The molding material may be clay and may be included in the kit or be obtained from a separate source by the user. Corn starch or a similar talc-like material may be included and used as a release agent while working with the molding material. Lamination of the sea turtle may proceed by rolling the clay with a dowel which may be provided in the kit. Typically, the thickness of the clay is kept to no more than $1/16^{th}$ of an inch. A section of clay may then be placed on the formed sculpture and is preferably placed such that a smooth surface of the clay covers the sculpture including the crevices or cracks between the designs of the form and not overlapping clay. The partially-modeled form may be placed onto pedestal 28 shown in FIG. 4(*c*) in order to articulate the limbs and apply additional clay to them as needed. For example, the fore limbs and hind limbs may be bent slightly in order to provide a more realistic appearance to the sculpture. Small balls of clay may be flattened and added to the fore limbs and hind limbs as well as the head, neck, etc., in order to lend realism to the sculpture.

Figure 6:
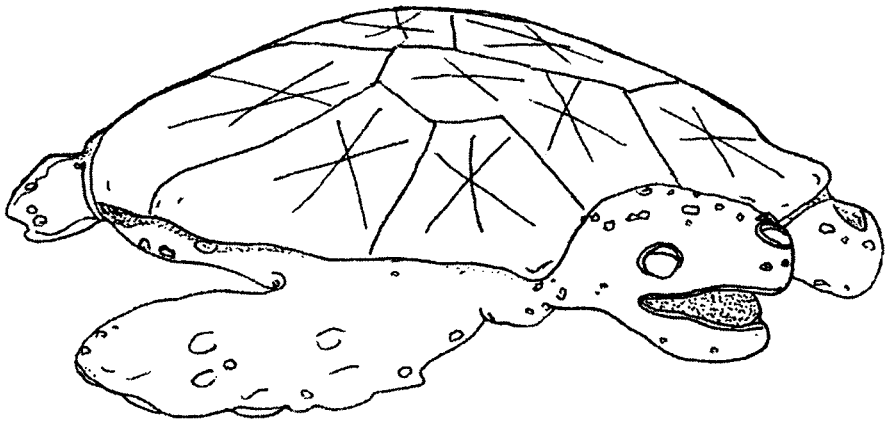
FIG. 6 depicts the armature of a sea turtle after the molding has been cured.

Once the form has been cured, shown in FIG. 6, the resulting armature may be colored and stylized. One or more colorants may include in the kit for this purpose. Typically, colorants are acrylics or paints. Palette 30 (preferably pre-scored or pre-cut) may be included in the kit for mixing of paints or acrylics with opening 30*a* for handling the palette.

Figure 7:
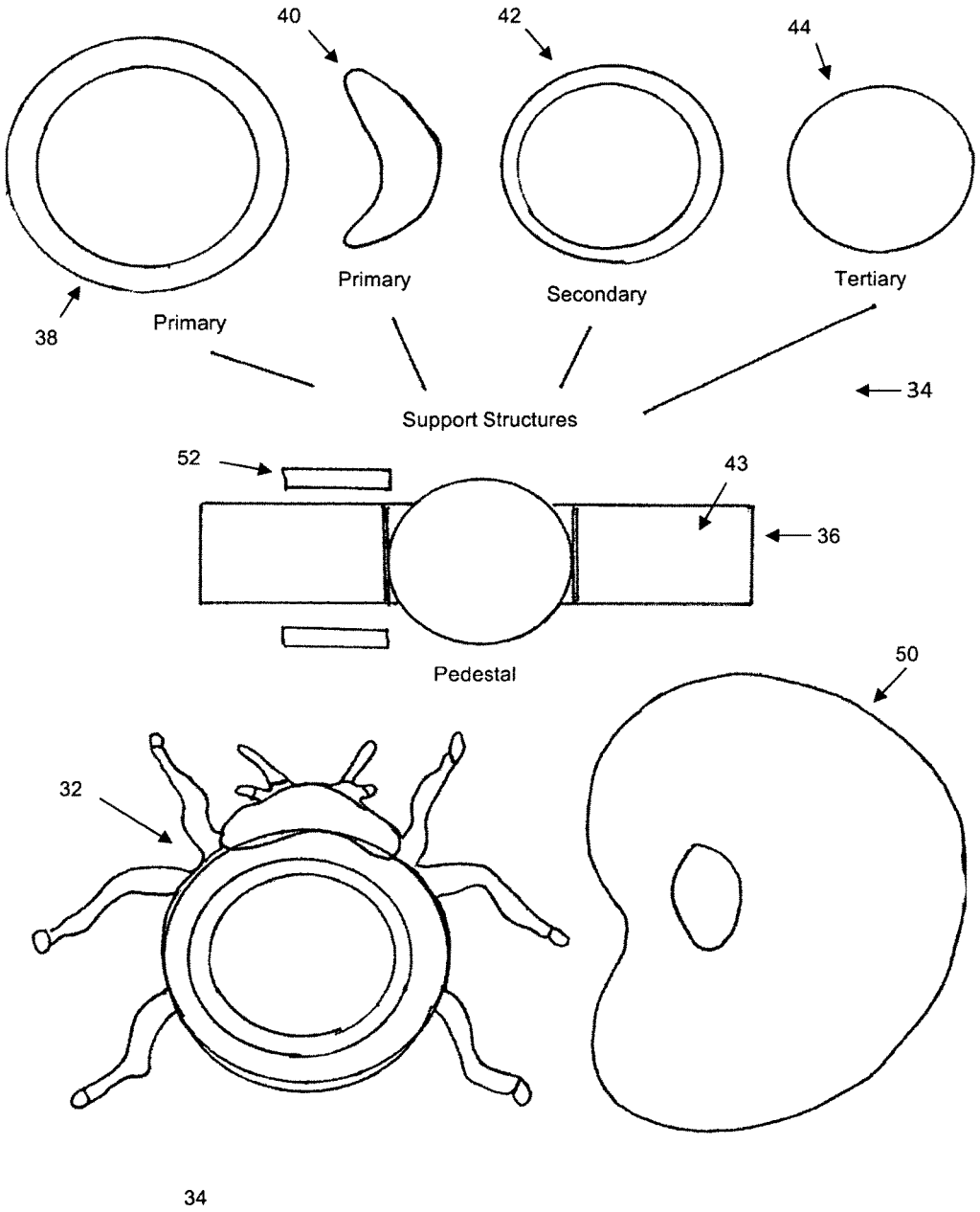
FIG. 7 depicts a planar surface member of a kit for a lady bug containing the underframe and some support structures.

FIG. 7 displays another illustration for the disclosure illustrating the making of a three-dimensional lady bug. As illustrated, underframe 32 of the lady bug along with first primary support structure 38, second primary support structure 40, second support structure 42 and tertiary support structure 44 along with palette 50 may be removed from planar surface member 34, shown in FIG. 7. In addition, pedestal 36 may be on planar surface member 34. Slot 52 may be located on planar surface member 34 for placement of feet 43 of pedestal 36.

Any or all of underframe 32, first primary support structure 38, second primary support structure 40, second support structure 42 or tertiary support structure 44 may have incorporated or attached a flexible member (not shown) which enables the bending and shaping of the component.

Adhesive may be applied to the bottom of first primary support structure 38 bearing a "1" as identification marker. First primary support structure may then be adhered to the top of underframe 32 within identification marker "1" on the underframe.

An adhesive may then be applied to second primary support structure 40 bearing identification marker "2" and second primary support structure 40 may then be adhered to underframe 32. The combination of first primary support structure 38 and second primary support structure 40 to underframe 32 forms the sub-surface structure.

Secondary support structure 42 may be adhered to first primary support structure 38 using adhesive. As illustrated the area on primary support structure 38 where the secondary support structure 42 is adhered is labeled with identification marker "3". The label "3" on secondary support structure 42 is overlaid onto the area identified as "3" on primary support structure 38.

Tertiary support structure 44 may then be applied onto secondary support structure 42. The area for application of tertiary support structure 44 onto secondary support structure 42 may be marked as "4", a like number being assigned to tertiary support structure 44.

Figure 8:
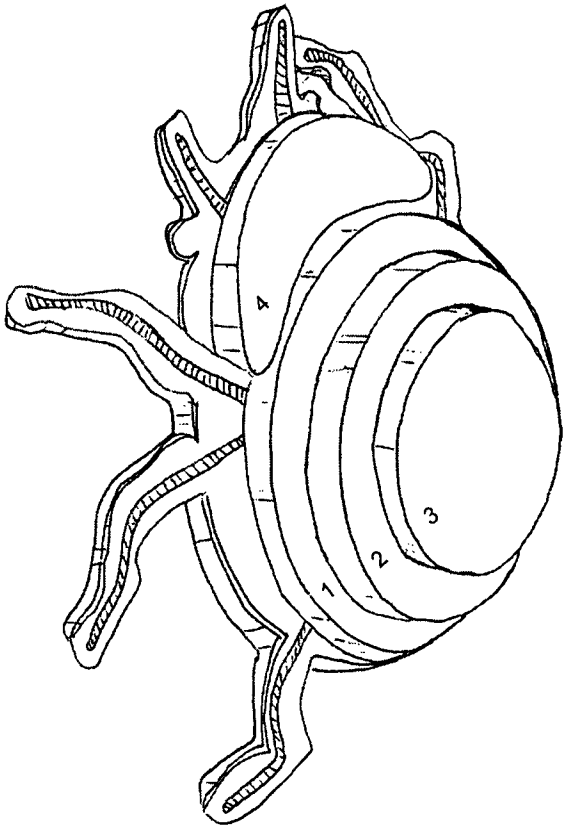
FIG. 8 depicts the armature of a lady bug prior to molding.

A realistic depiction of a ladybug may be provided to the formed structure by pressing the legs on underframe 32 downwards. The presence of a flexible member within the legs of the lady bug provides the artist to articulate the legs into a desired position. FIG. 8 depicts the armature of the lady bug.

Lamination of the lady bug may then proceed by rolling the clay to a desired thickness, typically no more than $1/16^{th}$ of an inch. A section of clay may then be placed on the formed sculpture and is preferably placed such that a smooth surface of the clay covers the sculpture including the crevices or cracks between the designs of the form. The partially-modeled form may be placed onto pedestal 36 in order to articulate the shape of the lady bug and clay then applied. After curing of the clay, the form of the lady bug may be detailed. For instance, Elytra may be added to the back of the lady bug to provide a wing casing. To do so, a slit may be made from the center radius to the outer edge of first primary support structure 38. After curing, additional details or corrections may be made using additional clay. The cured structure may then be colored.

While exemplary embodiments of the invention have been shown and described, many variations, modifications and/or changes of the kit and method of using the kit, such as in the components, details of construction and operation, arrangement of parts and/or methods of use, are possible, contemplated by the patent applicant(s), within the scope of the appended claims, and may be made and used by one of ordinary skill in the art without departing from the spirit or teachings of the invention and scope of appended claims. For instance, the method of using the kit described above or claimed herein and any other methods which may fall within the scope of the appended claims can be performed in any desired suitable order and are not necessarily limited to any sequence described herein or as may be listed in the appended claims. Thus, all matter herein set forth or shown in the accompanying drawings should be interpreted as illustrative, and the scope of the disclosure and the appended claims should not be limited to the embodiments described and shown herein.

What is claimed is:

1. A kit for sculpturing a three-dimensional object comprising:

(a) at least one planar surface member;

(b) a substantially thin and flat underframe attached onto and removable from the surface of the at least one planar surface member, the underframe bearing at least one identification marker and a shape-forming flexible material within the interior of the underframe;

(c) at least one substantially thin and flat primary support structure attached onto and removable from the surface of the at least one planar surface member, configured for placement onto the underframe in a substantially stacked relationship, the at least one primary support structure bearing at least one identification marker on its surface;

(d) one or more substantially thin and flat secondary support structures attached onto and removable from the surface of the at least one planar surface member, configured for placement onto the at least one primary support structure in a substantially stacked relationship and bearing at least one identification marker;

(e) an adhesive for adhering the at least one primary support structure onto the underframe in a substantially stacked relationship and the one or more secondary support structures onto the at least one primary support structure in a substantially stacked relationship;

(f) a molding material for placement onto the surface of the primary support structure and the one or more secondary support structures; and (g) one or more colorants wherein the underframe, the at least one primary support structure, and the one or more secondary support structures are configured to be removed from the surface of the at least one planar surface member and assembled into the substantially stacked relationship to form a three-dimensional structure onto which the mold material is placed to sculpture the three-dimensional object.

2. The kit of claim 1, further comprising one or more additional support structures wherein each additional support structure being substantially thin and flat is removably retained on the at least one planar surface member, wherein the one or more additional support structures are configured for placement onto the one or more secondary support structures in a substantially stacked relationship, and wherein the one or more additional support structures bears an identification marker.

3. The kit of claim 2, wherein at least one of the at least one primary support structures or the one or more secondary support structures has a shape-forming flexible material.

4. The kit of claim 3, wherein the shape-forming flexible material is within the interior of at least one of the at least one primary support structure or the one or more secondary support structures.

5. The kit of claim 3, wherein the shape-forming flexible material is on the exterior of at least one of the at least one primary support structure or the one or more secondary support structures.

6. The kit of claim 3, wherein the at least one primary support structure and the one or more secondary support structures contain a shape-forming flexible material.

7. The kit of claim 2, wherein the at least one identification marker on the one or more additional support structures corresponds to the area of the one or more additional support structures to be laid onto the corresponding identification marker of the preceding support structure.

8. The kit of claim 1, wherein the at least one identification marker on the underframe corresponds to the area of placement of the at least one primary support surface onto the underframe.

9. The kit of claim 1, wherein the at least one identification marker on the at least one primary support structure corresponds to the area of placement of the one or more secondary support structures onto the at least one primary support structure.

10. The kit of claim 1, wherein the kit further comprises a pedestal on the at least one planar member onto which the three-dimensional object may be set during sculpting of the three-dimensional object.

11. The kit of claim 1, wherein the at least one planar surface member is composed of paper or foam.

12. The kit of claim 1, wherein the underframe, at least one primary support structure or the one or more secondary support structures are pre-cut or pre-scored.

13. The kit of claim 1, wherein the underframe, at least one primary support structure or one or more secondary support structures are on a single planar surface member.

14. The kit of claim 1, wherein the shape-forming flexible material is wire, a metallic sheet, or non-metallic material.

15. The kit of claim 1, wherein the one or more colorants are paint, acrylics or lacquers or a combination thereof.

16. The kit of claim 1, wherein the molding material is clay.

17. A kit for sculpturing a three-dimensional object comprising the following components:

(a) one or more substantially thin and flat elements removably retained on a planar surface member and configured for forming an underframe of the sculpted three-dimensional object;

(b) at least one substantially thin and flat primary structure configured for placement onto the underframe in a substantially stacked relationship, the at least one primary structure removably retained on the planar surface member;

(c) at least one substantially thin and flat secondary structure configured for placement onto the at least one primary structure in a substantially stacked relationship, the at least one secondary structure removably retained on the planar surface member, and (d) a molding material for placement onto the surface of the primary support structure and the one or more secondary support structures, wherein at least one of component (a), (b) or (c) contains in its interior a shape-forming flexible material and wherein the combination of the one or more substantially thin and flat elements retained on the planar surface, the at least one primary structure retained on the planar surface member, and the at least one secondary structure retained on the planar surface member are configured to be assembled into the substantially stacked relationship to form a three-dimensional structure onto which the mold material is placed to sculpture the three-dimensional object.

18. The kit of claim 17, further comprising one or more additional substantially thin and flat structures configured for placement onto the at least one primary structure in a substantially stacked relationship, the one or more additional substantially thin and flat structures removably retained on the at least one planar surface member, wherein the combination of the one or more substantially thin and flat elements retained on the planar surface, the at least one primary structure retained on the planar surface member, the at least one secondary structure retained on the planar surface member and the one or more additional structures retained on the at least one planar member are configured to be assembled into the substantially stacked relationship to form the three-dimensional structure onto which the mold material is placed to sculpture the three-dimensional object.

19. The kit of claim 18, wherein at least two of the (i) the one or more substantially thin and flat elements of (a); (ii) the at least one primary structure of (b); (iii) at least one secondary structure; or (iv) the one or more additional structures contain a shape-forming flexible material.

20. The kit of claim 17, wherein at least two of the (i) the one or more substantially thin and flat elements of (a); (ii) the at least one primary structure of (b); or (iii) the at least one secondary structure of (c) contain a shape-forming flexible material.

21. The kit of claim 20, wherein the shape-forming flexible material is a wire, a metallic sheet, and/or non-metallic material.

22. The kit of claim 17, further comprising an adhesive.

23. The kit of claim 17, further comprising one or more colorants.

24. A method of sculpting a three-dimensional object by using the kit of claim 1, the method comprising:

(a) adhering onto the underframe the at least one primary support structure and forming a sub-surface structure;

(b) adhering the one or more secondary support structures onto the at least one primary support structure and forming an expanded three-dimensional structure;

(c) forming an armature of a three-dimensional object;

(d) applying the molding material onto the armature and hardening the molding material; and (e) applying the one or more colorants onto the hardened molding material, wherein either the underframe, the at least one primary support structure or the one or more secondary support structures contains a shape-forming flexible material and further wherein the underframe, the at least one primary support structure, and the one or more secondary support structure containing the shape-forming flexible material are assembled in a stacked relationship and may then be shaped by manipulating the shape-forming flexible material prior to step (c).

25. The method of claim 24, wherein the kit further comprises one or more additional substantially thin and flat structures on at least one planar surface member and further wherein prior to step (c), the one or more additional two-dimensional structures are added to the expanded three-dimensional structure.

26. The method of claim 25, wherein at least one of the one or more additional substantially thin and flat structures contains a shape-forming element.

27. A method of making a three-dimensional object by using the kit of claim 17, the method comprising:

(a) applying and adhering onto the underframe the at least one primary support structure and forming a sub-surface structure;

(b) applying and adhering the one or more secondary support structures onto the at least one primary support structure and forming an expanded three-dimensional object;

(c) forming an armature for the three-dimensional object comprising the underframe, at least one primary support structure and the one or more secondary support structures, wherein the underframe, the at least one primary support structure and/or the one or more secondary support structures is shaped by manipulating the shape-forming flexible material prior to step (c); and (d) applying the molding material onto the armature and hardening the molding material.

28. The method of claim 27, wherein the kit further comprises one or more additional substantially thin and flat support structures attached onto and removable from the surface of a planar surface member and further wherein after step (b), the one or more additional substantially thin and flat structures are added to the expanded three-dimensional structure to form the armature.

29. The method of claim 28, wherein at least one of the one or more additional substantially thin and flat structures contains a shape-forming element.

* * * * *